US010349688B2

(12) United States Patent
Forko

(10) Patent No.: US 10,349,688 B2
(45) **Date of Patent: *Jul. 16, 2019**

(54) WET SPORTSWEAR TAKEOFF HELPING MEANS

(71) Applicant: Michel Forko, Zagreb (HR)

(72) Inventor: Michel Forko, Zagreb (HR)

( * ) Notice: Subject to any disclaimer, the term of this patent is extended or adjusted under 35 U.S.C. 154(b) by 6 days.

This patent is subject to a terminal disclaimer.

(21) Appl. No.: 15/524,042

(22) PCT Filed: Nov. 11, 2014

(86) PCT No.: PCT/HR2014/000040
§ 371 (c)(1),
(2) Date: May 3, 2017

(87) PCT Pub. No.: WO2016/075500
PCT Pub. Date: May 19, 2016

(65) Prior Publication Data

US 2017/0311656 A1 Nov. 2, 2017

(51) Int. Cl.
*A41D 1/04* (2006.01)
*A41D 13/00* (2006.01)
(Continued)

(52) U.S. Cl.
CPC ..... *A41D 13/0015* (2013.01); *A41D 1/04* (2013.01); *A41D 27/24* (2013.01); *A47G 25/90* (2013.01);
(Continued)

(58) Field of Classification Search
CPC ..... A41D 13/129; A41D 2400/70; A41D 2400/44; A41D 3/005
See application file for complete search history.

(56) References Cited

U.S. PATENT DOCUMENTS 560,683 A 5/1896 Brüchner
724,758 A 4/1903 Todd
(Continued)

FOREIGN PATENT DOCUMENTS

JP 2002242008 A 8/2002

OTHER PUBLICATIONS

International Search Report issued in PCT/HR2014/000040 dated Jul. 3, 2015, 3 pages.
(Continued)

*Primary Examiner* — Sally Haden
(74) *Attorney, Agent, or Firm* — Greenberg Traurig, LLP

(57) ABSTRACT

A wet sportswear takeoff assist, situated at the back part of the sportswear includes one or more guides selected from a strip guide, mesh guide and tuck-in guide. The guides are equipped with the corresponding drawing attachment; the drawing attachment selected from strips, mesh and sliding back part. The drawing attachments are attached on one side to the hemline within a joint region; and on the opposite side to the gripper directly, or to an intermediate connection point. The guides are attached on any sportswear surface. The gripper is situated close to the sportswear top, within the neck region, to be easily griped and pulled by hand causing lifting of the sportswear back part despite friction with the wearer's skin. The invention is useful in protection of the sportswear while taking it off over the head, and also useful in helping the elderly or disabled take off an upper garment.

7 Claims, 5 Drawing Sheets

(51) Int. Cl.
*A41D 27/24* (2006.01)
*A47G 25/90* (2006.01)

(52) U.S. Cl.
CPC ..... *A41D 2400/44* (2013.01); *A41D 2400/70* (2013.01); *A41D 2600/10* (2013.01)

(56) References Cited

U.S. PATENT DOCUMENTS 823,534 A * 6/1906 Hutchinson ..... A41D 1/06 2/269
2,127,763 A 8/1938 Bentz
2,153,068 A * 4/1939 Arden ..... A41F 19/005 2/269
2,280,467 A * 4/1942 Blanc ..... A41D 19/0044 2/162
2,632,177 A * 3/1953 Bigger ..... A41B 9/04 2/406
2,687,530 A * 8/1954 Farnum ..... A41B 9/10 2/217
2,692,988 A * 11/1954 Rouse ..... A41B 9/06 2/217
2,714,718 A * 8/1955 Kramer ..... A41D 15/002 2/265
2,723,398 A * 11/1955 Tuteur ..... A41B 13/06 2/69.5
3,812,539 A * 5/1974 Muehlberg ..... A41D 10/00 2/69.5
4,773,101 A * 9/1988 Kapp ..... A41B 13/08 2/69.5
4,774,726 A * 10/1988 Garrett ..... A41D 1/22 2/105
5,101,514 A * 4/1992 Eklund ..... A41D 13/0537 2/87
D337,194 S * 7/1993 Marks ..... A41D 13/02 D2/738
5,299,323 A 4/1994 Schaefer et al.
5,315,712 A * 5/1994 McTaggart ..... A41D 27/00 2/105
5,367,709 A 11/1994 Teasley
5,539,932 A * 7/1996 Howard ..... A41D 1/06 2/227
5,546,606 A * 8/1996 Luckabaugh ..... A41D 1/22 2/211
5,717,999 A * 2/1998 Lurry ..... A41D 15/002 2/108
D402,439 S * 12/1998 Marks ..... A41C 1/10 D2/757
D402,440 S * 12/1998 Marks ..... D2/851
6,317,894 B1 * 11/2001 Blechman ..... A41D 15/002 2/115
6,859,944 B2 * 3/2005 Kim ..... A41D 1/06 2/237
7,168,103 B2 * 1/2007 Aldridge ..... A41D 13/02 2/458
7,412,728 B2 * 8/2008 Alesina ..... A41D 27/28 2/69
7,841,020 B2 * 11/2010 Mayfield ..... A41D 13/1209 2/227
7,971,272 B2 * 7/2011 Bailey ..... A41B 13/005 2/269
8,707,465 B2 * 4/2014 Reynolds ..... F41C 33/048 2/102
8,826,466 B1 * 9/2014 Michaelis ..... A41D 15/002 2/69
9,089,174 B1 * 7/2015 Michaelis ..... A41D 13/0015
9,162,089 B2 * 10/2015 Harshbarger ..... A62B 35/00
9,265,292 B2 * 2/2016 Smith ..... A41D 13/02
9,468,238 B2 * 10/2016 Keathley ..... A41D 3/00
9,743,692 B2 * 8/2017 Palese ..... A41C 1/10
2004/0237168 A1 * 12/2004 Braun ..... A41D 27/28 2/93
2006/0143779 A1 7/2006 Lee
2009/0019622 A1 * 1/2009 Mayfield ..... A41D 13/1209 2/455
2010/0281597 A1 11/2010 Lang
2011/0277212 A1 11/2011 Jones
2016/0165971 A1 * 6/2016 Smith ..... A41D 13/02 2/456
2016/0213184 A1 * 7/2016 Kobyluck ..... A47G 25/90
2017/0332709 A1 * 11/2017 Forko ..... A41D 1/04

OTHER PUBLICATIONS

Written Opinion of the International Searching Authority issued in PCT/HR2014/000040 dated Jul. 3, 2015, 5 pages.

* cited by examiner

WET SPORTSWEAR TAKEOFF HELPING MEANS

CROSS REFERENCE TO RELATED APPLICATIONS

This application is the U.S. National Phase Application of PCT/HR2014/000040, filed Nov. 11, 2014, the contents of such application being incorporated by reference herein.

TECHNICAL FIELD

The present invention discloses a sportswear takeoff helping means that helps in taking off wet sportswear from the wearer, especially the upper part of the sportswear. The helping means belongs to the technical field dealing with details of garments that have an additional specific technical function.

TECHNICAL PROBLEM

Nowadays healthy life trends include more and more people in various indoor and outdoor sport activities for which a special garment is designed and worn. A part of the mentioned activities is carried out in the sportswear designed to be extremely skintight to the wearer. During the activities the sportswear becomes wet from sweat resulting from exercise, environmental conditions, or both. Once being wet, it is observed that the upper sportswear is almost impossible to be taken off over the wearer's head. The assistance of a colleague is needed, otherwise there is a high risk that the sportswear will be damaged. This is in particular noted in garments equipped with high-performance, microfiber, polyester fabric that should move sweat away from the body and onto the fabric surface, where it evaporates. However, in case of rain or heavy exercises being performed, the sportswear becomes entirely wet and impossible to be taken off.

So, the primary technical problem is to construct a simple, reliable and aesthetically acceptable helping means that allows the wet sportswear, in particular the upper sportswear, designed to be extremely skintight for the wearer, to be simply taken off over the wearer's head.

Elderly people have problems with taking off T-shirts or similar garments over the head due to their health conditions of the spinal column, joints or limbs. Also obesity may generate similar inability. Therefore, the solution of the primary technical problem can be easily extended to the above-observed problem. According to an aspect of the invention, if the wearer is capable of touching the neck, then it is possible to use the takeoff helping means according to aspects of the invention.

The technical problem is solved with a device basically composed from guides equipped with the corresponding, i.e. compatible, drawing means attached to the hemline situated in the back of the garment to be sufficiently lifted toward the neck portion and subsequently captured by the wearer's hand.

PREVIOUS STATE OF THE ART

The technical problem which is solved by aspects of the present invention is the construction of a novel takeoff helping means that helps in taking off the wet skintight sportswear over the wearer's head. There are well known solutions in the art which comprise zippers or mechanic/magnetic snaps that allow the sportswear to be unzipped or unfastened along one or more hems which facilitate the takeoff procedure. However, such zippers or snaps are also cumbersome to be handled by one person, not to mention that such solutions locally change the user's experience in wearing the skintight sportswear.

Probably one of the earliest technical solutions, where a part of the garment is lifted, is mentioned in the U.S. Pat. No. 560,683; inventor E. Brückner, which is incorporated by reference. The document teaches about trousers for bicyclist capable to be drawn up to the knees and retained in this shortened condition. The implemented system is composed of drawstrings and appropriate guides with a lock system.

Document U.S. Pat. No. 724,758; inventor H. M. Todd, which is incorporated by reference, teaches about a skirt or train lifter. The object of that invention is to provide a device adapted to raise and drop the back and side breadths of women's skirts without the necessity of using the hand on the breadths. The invention consists primarily of a wire frame adapted to be attached in the back of the skirt, provided with suitable loops through which suitable tapes or cords pass adapted to be tied together or otherwise secured at the waist of the wearer.

Document U.S. Pat. No. 2,127,763; inventor G. B. Bentz, which is incorporated by reference, teaches about improvements in overcoats, topcoats, raincoats, capes and the like. The primary focus of that invention is to prevent the garments to be dragged down on the floor or to be stepped upon once left on a chair or similar. The contraction of the garment is achieved by the means of cords, tapes, small chains or similar means, that can be fixed to different positions within the garment, thus effectively producing a lifting the hemline.

Document U.S. Pat. No. 5,299,323; inventor A. Schaefer et al., which is incorporated by reference, discloses an adjustment system for forming a repeatedly adjustable hem on a garment. It provides an adjustment mechanism comprising a cord with one end that is attached to the garment's inside hem while the other end passes through a holding pocket or channel that is secured to the garment's inside seam. The advantage of the cited invention is to enable the garment to be conformed to the person without any tailoring skills.

Document U.S. Pat. No. 5,367,709; inventor N. A. Teasley, which is incorporated by reference, discloses adjustable clothing for infants and toddlers that reversibly adjusts in length what accommodates the growth of a child. Adjusting is performed via drawstrings situated in the side seams, and fixation is provided via knots formed by the drawstrings.

Finally, document US 2010/0281597; inventor J. A. Lang, which is incorporated by reference, discloses a partial garment lift/quick-access system for installation in the upper body garment for wearers who have a need for immediate and unobstructed access to the waist/belt line to retrieve essential items. The quick-access system allows the wearer to immediately expose an item at the waist/belt line, for a complete and unobstructed access by pulling a simple cord at the chest pocket. This action produces a curtain-like effect at the bottom hem of the garment; assisting the wearer to make a rapid hand-to-item contact while keeping the hem of the garment suspended for the duration of the required activity.

From the above-cited documents it is easy to conclude that none of the cited documents solve the takeoff problem observed with the skintight sportswear. Furthermore, the drawstrings or cords are used to lift exclusively trousers, skirts, or similar garments and to adjust or modify the garments appearance and functionality.

However, none of the cited documents contemplate about a takeoff device for skintight and wet sportswear by applying more elaborated means such as strips, a mesh or even a sliding part to achieve the desired technical effect.

SUMMARY OF INVENTION

An aspect of the present invention solves the technical problem by lifting the hemline situated on the sportswear back that is rather different from the above-cited well-known solutions. It is instructive to examine the previous state of the art in the segment; i.e. to search for the garment that is equipped with the means for lifting or taking off the garment, or at least a part of it.

An aspect of the present invention discloses a wet sportswear takeoff helping means for the upper sportswear that is worn extremely tight to the wearer's skin. The helping means is made on the back part of the sportswear and consists of one or more identical guides where guides are selected to be strip guides, mesh guides or tuck-in guides. The selected guides are equipped with the corresponding drawing means, i.e. strips, mesh or sliding back part. The beginnings of all drawing means are attached to the sportswear back hemline within a joint region, and another side of the drawing means ends into the griping means or into an intermediate connection region. The griping means is situated close to the sportswear top, within the wearer's neck region, to be easily griped and pulled by the hand—causing the lifting of the sportswear back part. The takeoff helping means can be formed on the inner or outer surface of the sportswear.

In the first embodiment one or more guides are selected to be strip guides formed from a material that is stitched via seams to one of the sportswear sides, forming together with the sportswear sleeves that allow the movement of the strips within. Each strip guide begins from the strip guide beginning situated close to the hemline. In one variant, each strip guide ends with a strip guide end, situated close to the neck part of the sportswear, and where each strip is independently connected to the griping means. In another variant of the embodiment strip, the guides overlap in a manner that a part or all of the strip guides overlap within the overlapping region and corresponding strips pass one over another through the overlapping region independently. In yet another variant of the same embodiment; a part of the strip guides ends in the overlapping region and the corresponding strips are connected together in the connection region formed on one strip that is situated within the guide which passes across the overlapping region close to the neck part of the sportswear.

In the second embodiment the guide is selected to be a mesh guide, formed from the material that is stitched via seams to the sportswear, forming with the said sportswear a sleeve that allows the movement of the mesh within. The mesh guide begins from the mesh guide beginning situated close to the hemline. In the first variant of the same embodiment, the mesh of a rectangular form is inserted into the corresponding mesh guide, and the mesh is attached on one of its ends to the joint region extending all over the back part of the sportswear hemline. On the other side, the mesh is attached to the griping means selected to be a handgrip. In yet another variant of the same embodiment, the mesh of a trapezoid form is inserted into the corresponding mesh guide. The mesh is attached via a trapezoid base to the joint region extending all over the back part of the hemline. The mesh constriction that is formed on the opposite side is coming out of the mesh guide end. The mesh constriction serves as a griping means. It is equipped with a fastening means to attach the mesh constriction to the fastening means formed on the sportswear.

In the third embodiment the guide is selected to be a tuck-in guide formed at the neck part of the sportswear. The guide is made from a material stitched to the sportswear forming a short sleeve that allows the sliding back part to pass the tuck-in guide by its constriction.

The constriction extends from the sliding back top part and is used as a griping means. The sliding back part is in direct contact with the wearer's skin, and fixed only via its lower part within the joint region that is extended over the back part of the hemline. The sliding back part forms a back of the sportswear that is separated from it, except in the joint region. Preferably, the sliding back part has a trapezoid form whose base is attached to the hemline, and where its constriction is used as the griping means with a fastening means on the end.

An aspect of the present invention described can be used within an ordinary upper garment as a takeoff means helping elderly or disabled people to take off the upper garment.

BRIEF DESCRIPTION OF DRAWINGS

The above-cited embodiments were described via FIGS. 1-7 representing some of the invention variants.

DETAILED DESCRIPTION

The garment equipped with a high-performance, microfiber, polyester fabric such as Nike's DRI-FIT® is designed to remove sweat away from the body and to the fabric surface, where it evaporates. However, in case of rain or heavy exercises being performed, the sportswear becomes entirely wet. In case of the upper sportswear it becomes almost impossible to take it off over the head by the wearer alone. Usually the takeoff procedure requires one person for assistance in order not to damage the skintight sportswear.

There are well-known solutions in the art that comprise zippers or snaps to facilitate the takeoff procedure. However, such technical solutions worsen the wearer's experience in case of skintight sportswear, and many market researchers found it unacceptable for the end-users. The present invention helps to solve the above-observed technical problem via three embodiments described hereby in detail.

Figure 1A:
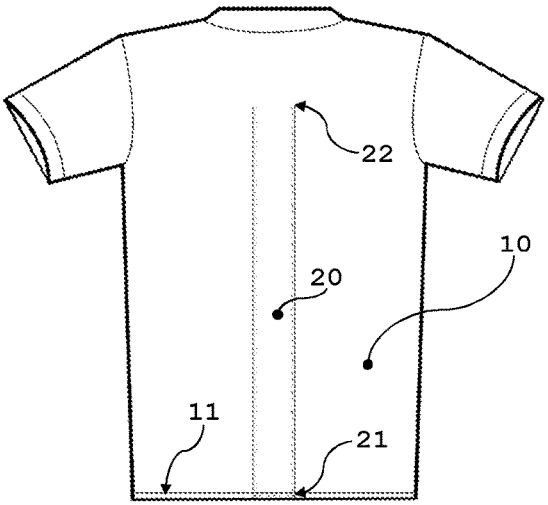
FIGS. 1A, 1B, 1C and 1D show the first embodiment where only one strip guide is used to accomplish the desired technical effect.
Figure 1B:
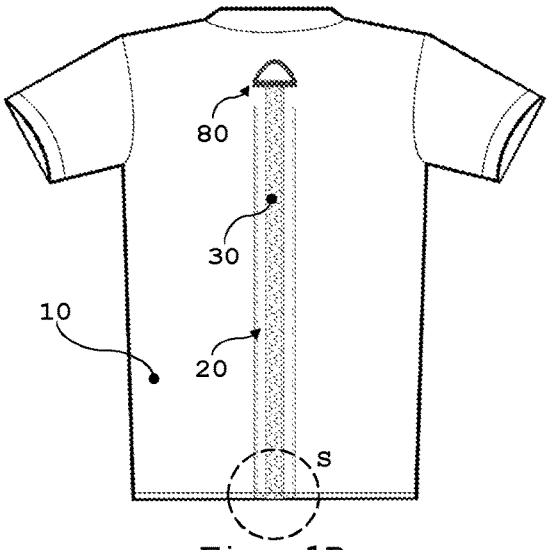
Figure 1C:
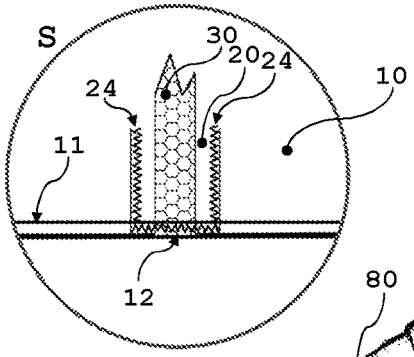

The first embodiment represents the simplest way to solve the present technical problem and it is depicted in FIGS. 1A, 1B, 1C and 1D. FIG. 1A shows the back part of an upper sportswear (10) where the takeoff helping means is mounted in the inner side of the fabric used for the said sportswear (10). The takeoff helping means is formed from the strip (30) that is firmly joined with the hemline (11) in the joint region (12) via stitching or any other suitable technique known in the art. In case of a polyester strip (30) or similar manmade material, fixation can be done even with an ultrasound welding procedure. The way of joining the strip (30) to the hemline (11) is depicted in FIG. 1C. It is important that the joint region (12) is formed at least a centimeter or more wide in order to distribute the applied user's force to the joint region (12) area, i.e. the exerted pressure to the hemline (11) material, in a manner that is not harmful for the material used to form the sportswear (10). This is the first reason why a simple drawstring is not suitable especially if fixed in a narrow spot to the hemline. The strip (30) can be manufactured from any suitable material, possibly from the mesh-like material or any other material sufficiently breathable for the wearer's skin. This is another advantage of using the flat mesh-like material to form the strip (30) in comparison with the drawstrings mentioned in the prior art. Such a strip (30) can be easily guided and fixed, and the wearer practically does not feel the presence of one or more strips (30) within the strip guides (20), and the sportswear retains its initial characteristics and aesthetic appearance. Another reason is that new generation of materials, such as DRI-FIT®, are layered and body-mapping fabrics where implementation of additional layers is rather straightforward.

Figure 1D:
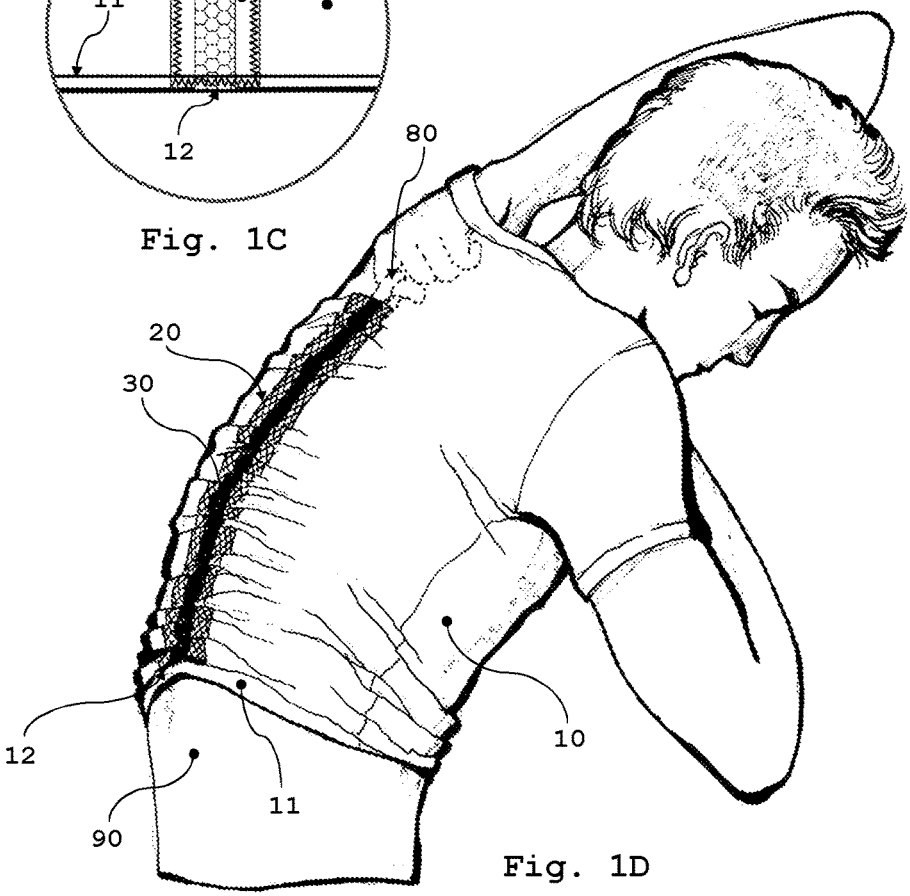

The strip guide (20) extends from the hemline (11) to the neck portion of the sportswear (10), as seen in FIG. 1A. The strip guide beginning (21), the strip guide end (22), as well as the strip guide by itself is fixed along its length via appropriate seams (24) to the sportswear fabric; FIG. 1C. For the desired technical effect it is not necessary that the side seams (24) are continuous along the entire strip guide (20) length, as self-understandable for a person skilled in the art. The strip guide beginning (21) can overlap the joint region (12) and can be seamed with the identical seam used in the joint region (12). The strip guide (20) in this embodiment can be manufactured from a skin-breathable material that is stitched with the seams (24) to the sportswear fabric in order to form a sleeve, which allows the strip (30) to move along. FIG. 1B shows the interior construction of the sportswear (10) when the back material is removed and the relative position of the strip (30) within the strip guide (20) is reveled. The upper part of the strip (30) that is extended close to the wearer's neck is equipped with the appropriate griping means; hereby chosen to be a handgrip (80), as seen in FIG. 1D.

In this simplest embodiment, the wearer pulls the handgrip (80) situated close to the neck towards the head which results in lifting of the back hemline (11) along the wearer's body despite the significant friction produced by the body-mapping fabric used. However, the technical result of the simplest embodiment is sometimes not good enough. It is noted that the friction forces can be strong enough to prevent the helping takeoff means to function correctly, i.e. especially if the initial significant tensions in the body-mapping fabric is greater than the user's takeoff force. Then, the distortion of the hemline is the only technical effect produced. In order to remove the observed, several variants of the same embodiment are proposed and depicted in FIGS. 2A-4C.

Figure 2A:
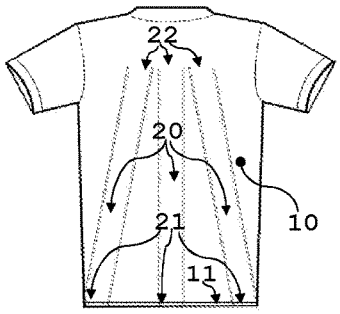
FIGS. 2A, 2B and 2C show the same embodiment having three independent strip guides.
Figure 2B:
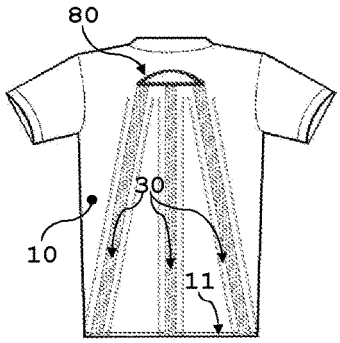
Figure 2C:
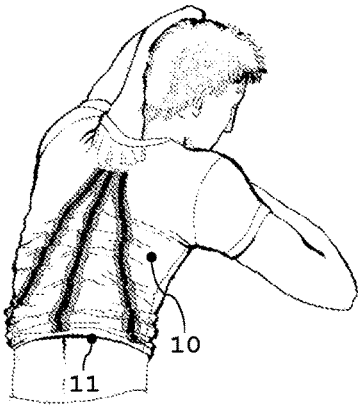

In the variant presented in FIG. 2A, multiple strip guides (20) are positioned to the inner backside of the sportswear (10). In this example three strip guides (20) were used, where the two side strip guides (20) are slightly inclined to the central one to distribute the pulling force produced by the wearer equally. Each strip guide (20) is equipped with the appropriate strip (30) fixed to the hemline (11) in the above-specified manner. Each strip (30) is independently fixed to the gripping means, and chosen to be a handgrip (80), FIG. 2B. The actual use is depicted in FIG. 2C that clearly demonstrates uniformity of the hemline (11) elevation by the applied force. For a person skilled in the art it is evident that the number of the used guides (20) is arbitrary and should be chosen in accordance with the size of the sportswear (10), body-mapping fabric tension and desired technical effect that should be achieved.

Figure 3A:
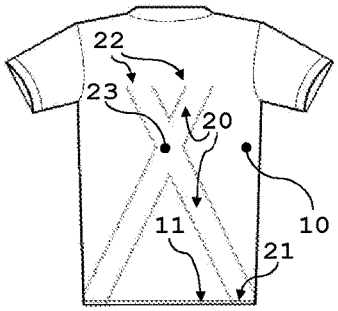
FIGS. 3A, 3B and 3C show the same embodiment having two strip guides that overlap.
Figure 3B:
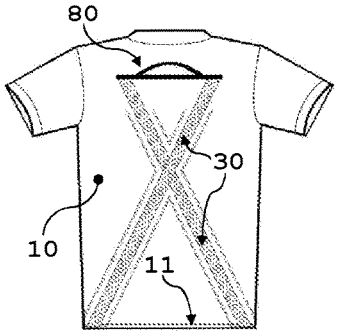
Figure 3C:
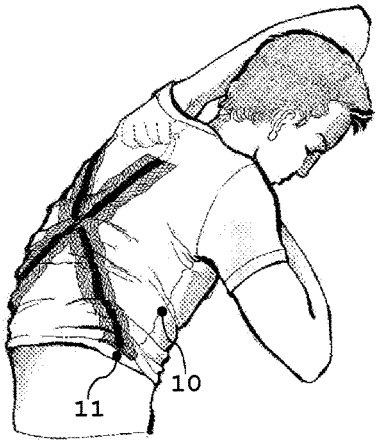

In another variant of the same embodiment presented in FIG. 3A, two strip guides (20) are positioned to the inner backside of the sportswear (10). In this example the two overlapping strip guides (20) were used. Each strip guide, (20) which begins from the hemline (11), overlaps in the overlapping region (23) forming a stylized letter X with the other guide (20) and continues to the neck part of the sportswear (10). Again the distribution of the pulling force produced by the wearer is equally distributed along the hemline. Each strip guide (20) is equipped with the appropriate strip (30) fixed to the hemline (11) and is crossing one over another in the overlapping region (23). Each strip (30) is again independently fixed to the gripping means, and chosen to be a handgrip (80), FIG. 3B. The actual use is depicted in FIG. 3C that clearly demonstrates uniformity of the hemline (11) elevation by the applied force that is better than the one in the simplest embodiment depicted on FIG. 1D.

Figure 4A:
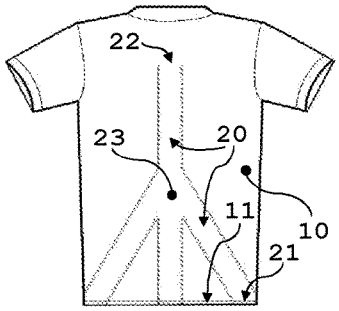
FIGS. 4A, 4B and 4C show the same embodiment having three strip guides where two are joined to the central one.
Figure 4B:
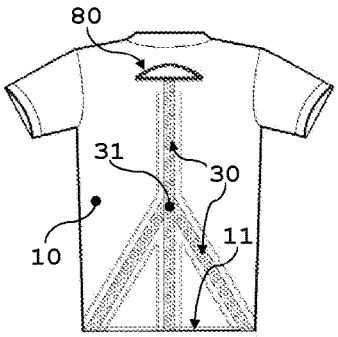
Figure 4C:
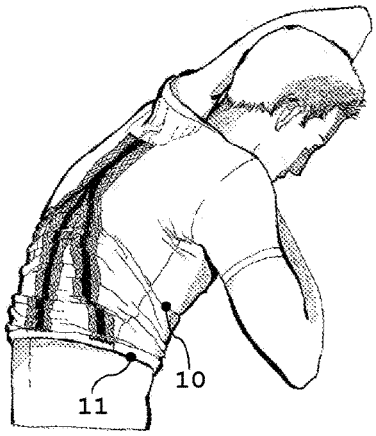

In yet another variant of the same embodiment presented in FIG. 4A, three strip guides (20) are positioned to the inner backside of the sportswear (10). In this example the two side strip guides (20) were inclined to the central one, they begin at the hemline (11) and end within the overlapping region (23). The centrally positioned strip guide (20) begins from the hemline (11) and passes the overlapping region (23) and continues to the neck part of the sportswear (10). FIG. 4B shows the distribution of the appropriate strips (30); the two side strips (30) end in the connection region (31) where they are stitched or differently firmly connected to the centrally positioned strip (30). Again the distribution of the pulling force produced by the wearer is equally distributed along the hemline despite the fact that only one strip (30) is connected to the gripping means chosen to be a handgrip (80), FIG. 4B. The actual use is depicted in FIG. 4C and it demonstrates uniformity of the hemline (11) elevation that is close to the variant depicted in FIG. 2C. Again, for a person skilled in the art it is evident that the number of the used guides (20) is arbitrary and should be chosen in accordance with the size of the sportswear (10), body-mapping fabric tension and desired technical effect that should be achieved.

In this first embodiment the preferred technical solution is that the takeoff means is situated entirely on the inner surface/fabric of the sportswear (10) due to aesthetic reasons. However, for a person skilled in the art, it is evident that the entire takeoff helping means can be equivalently mounted onto the outer side of the sportswear (10), and that in that case the griping means will be all the time visible to others.

By analyzing the above technical effect we may conclude from the first embodiment that a greater number of parallel strips are better in producing uniformity of the pulling force to the hemline (11). This teaching will be used in forming the second embodiment of the technical solution.

Figure 5A:
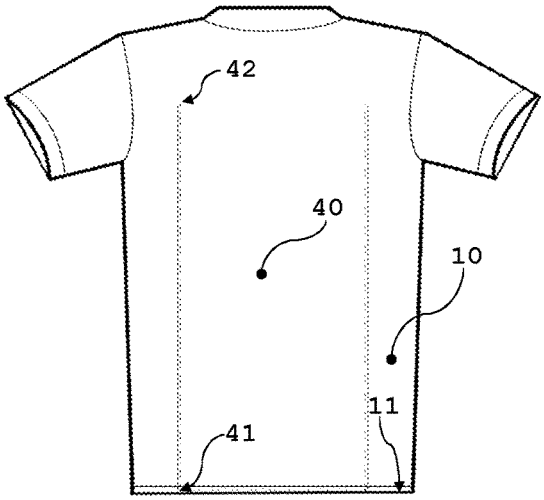
FIGS. 5A, 5B, 5C and 5D show the second embodiment where the mesh guide is used to accomplish the desired technical effect, the mesh guide is selected to be a rectangular one.
Figure 5B:
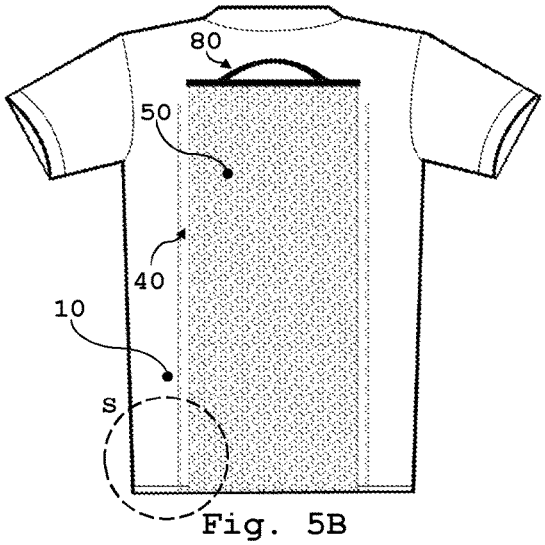
Figure 5C:
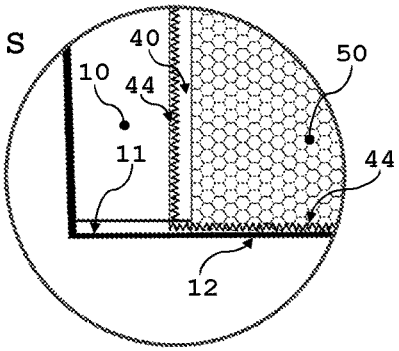

The second embodiment is depicted in FIGS. 5A, 5B, 5C and 5D. To simplify the explanation, this embodiment is in principle equal to the first embodiment depicted in FIGS. 1A, 1B, 1C and 1D where the width of the strip is extremely enlarged as well as the corresponding strip guide. FIG. 5A shows the back part of the upper sportswear (10) where the takeoff helping means is mounted into the inner side of the fabric used for the said sportswear (10). The takeoff helping means is formed from the mesh (50) that is firmly joined with the hemline (11) in the joint region (12) via stitching or any other suitable technique known in the art. In case of a polyester mesh (50) or similar manmade material, the fixation can be done even with the ultrasound welding procedure as in the first embodiment. The way of joining the mesh (50) to the hemline (11) is depicted in FIG. 5C. Considering the fact how wide the joint region (12) is, in the present embodiment the applied user's force to the joint region (12) area is distributed along the back part of the hemline (11), so the pressure, i.e. the force over the area, is considerably smaller than in the first embodiment discussed.

The mesh (50) can be manufactured as a real mesh with low density, where the unit mesh size is of 1 cm or more. It can also be made from a denser fiber material sufficiently breathable for the wearer's skin such as DRI-FIT® or similar. So, the "mesh" as used hereby has to be understood as a breathable material for the wearer's skin, rather than a mesh in a standard literal meaning.

Figure 5D:
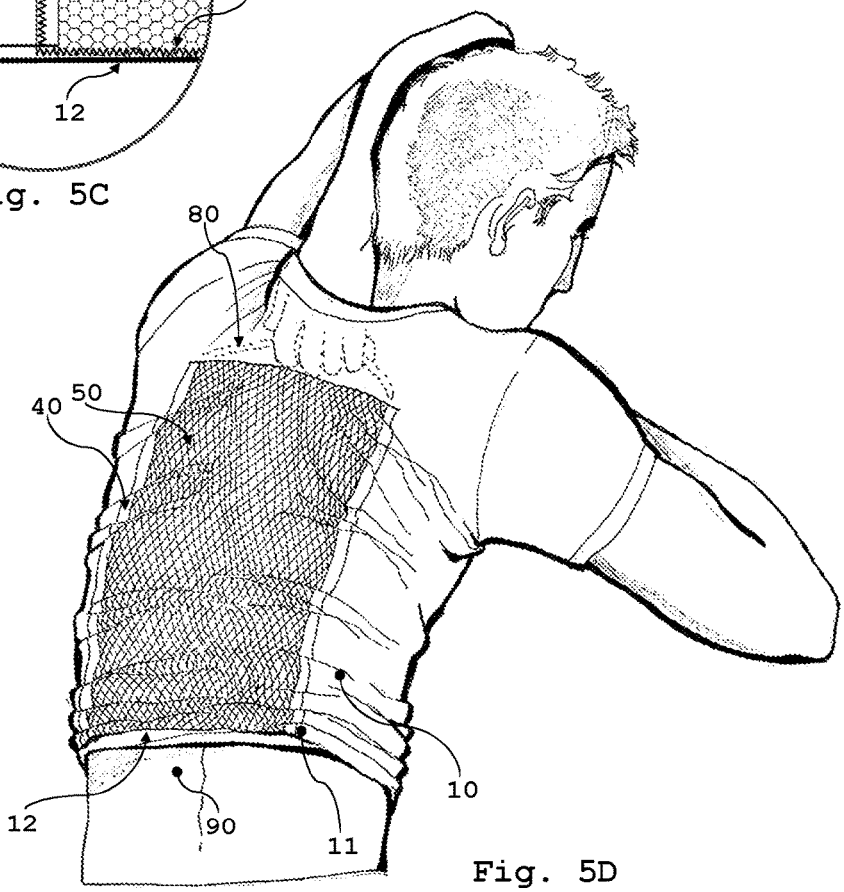

The mesh guide (40) extends from the hemline (11) to the neck portion of the sportswear (10), as seen in FIG. 5A. The mesh guide beginning (41), the mesh guide end (42), as well as the mesh guide by itself is fixed along its length via appropriate seams (44) to the sportswear fabric; FIG. 5C. For the desired technical effect it is not necessary that the side seams (44) are continuous along the entire mesh guide (40) length, as self-understandable for a person skilled in the art. The mesh guide beginning (41) can overlap the joint region (12) and can be seamed with the identical seam used in the joint region (12). The mesh guide (40) in this embodiment can be manufactured from a skin-breathable material that is being stitched with the seams (44) to the sportswear fabric in order to form a sleeve, which allows the mesh (40) to move along. FIG. 5B shows the interior construction of the sportswear (10) where the back material is removed and the relative position of the mesh (50) within the mesh guide (40) is revealed. The upper part of the mesh (50), which is extended close to the wearer's neck, is equipped with the appropriate griping means; hereby chosen to be a handgrip (80), as seen in FIG. 5D. This embodiment is almost perfect for producing the desired technical effect. However, this variant still occupies a large portion of the wearer's back and in some cases heat and moisture exchange with the surroundings can be affected, so another variant is proposed.

Figure 6A:
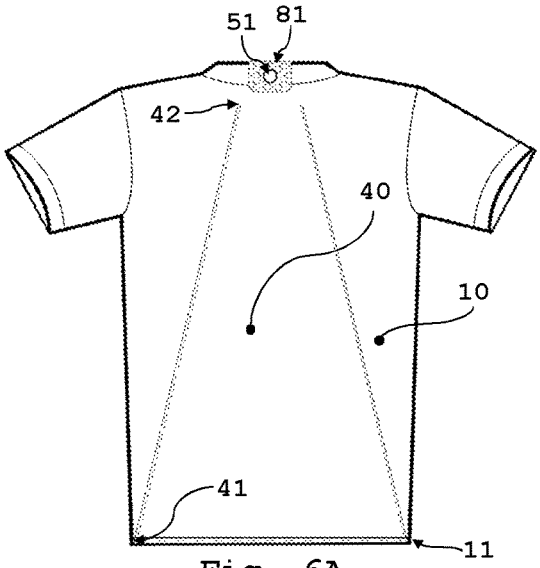
FIGS. 6A, 6B and 6C show the same embodiment where the mesh is selected to be of a trapezoidal form with the constriction that serves as the gripping means.
Figure 6B:
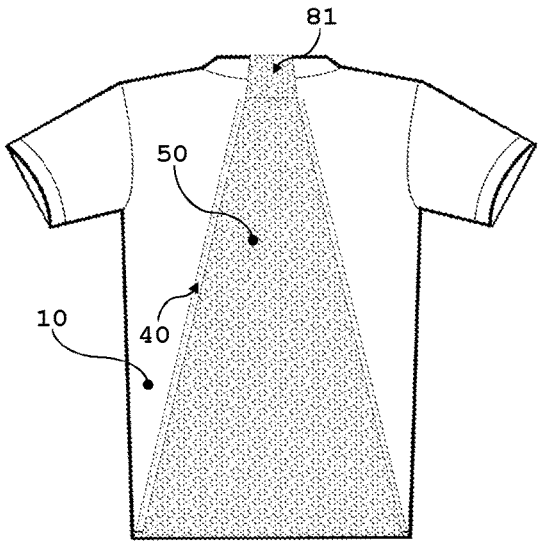
Figure 6C:
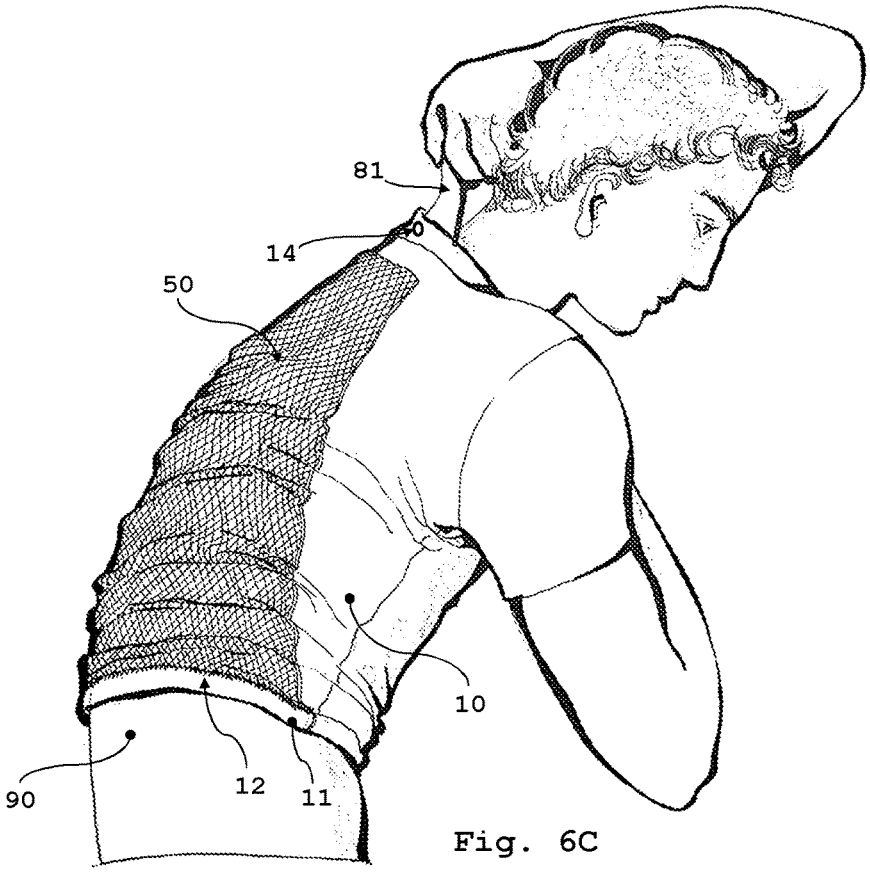

One variant of the second embodiment is depicted in FIGS. 6A, 6B and 6C. In order to improve the heat and moisture exchange with the surroundings, the mesh (50) is formed in a trapezoidal form. The corresponding mesh guide (40) is formed to follow the shape of the mesh (50); the mesh guide beginning (41) is situated close to the hemline (11) and inclined towards the neck part where the mesh guide end (42) is situated, see FIG. 6A. In particular, FIG. 6B reveals the trapezoidal mesh (50) situated within the trapezoidal mesh guide (40). The trapezoidal mesh (50) is extended into the mesh constriction (81) that is going out from the sportswear (10) to be folded and secured via the fastening means (51) to the corresponding fastening means (14) formed on the sportswear (10). The constriction (81) is simultaneously used as a griping means and pulling means that is easily secured to the sportswear via the fastening means (51, 14). The fastening means can be chosen to be ordinary snaps, areas equipped with the Velcro® hooks and loops, or any other fastening means used in the field. The actual usage of the mentioned variant is depicted in FIG. 6C.

Figure 7A:
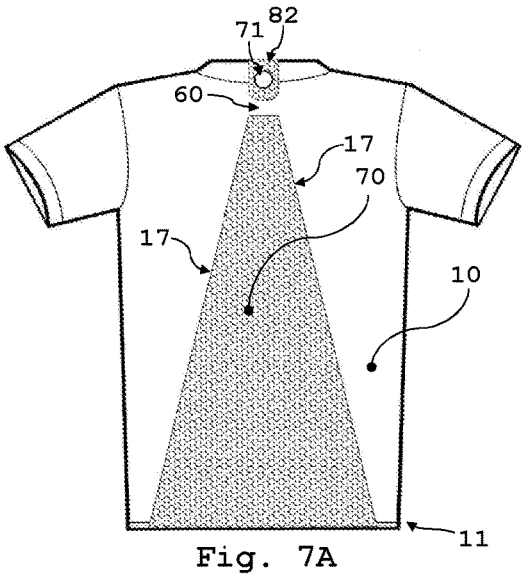
FIGS. 7A, 7B and 7C show the third embodiment were the tuck-in guide is used to accomplish the desired technical effect; the drawing part is selected to be a sliding back part of the sportswear.
Figure 7B:
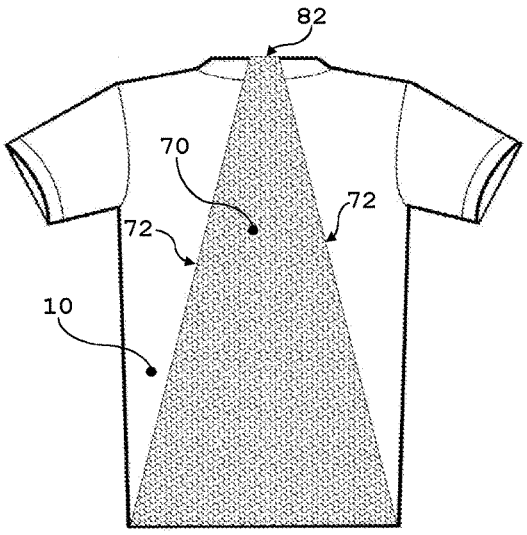
Figure 7C:
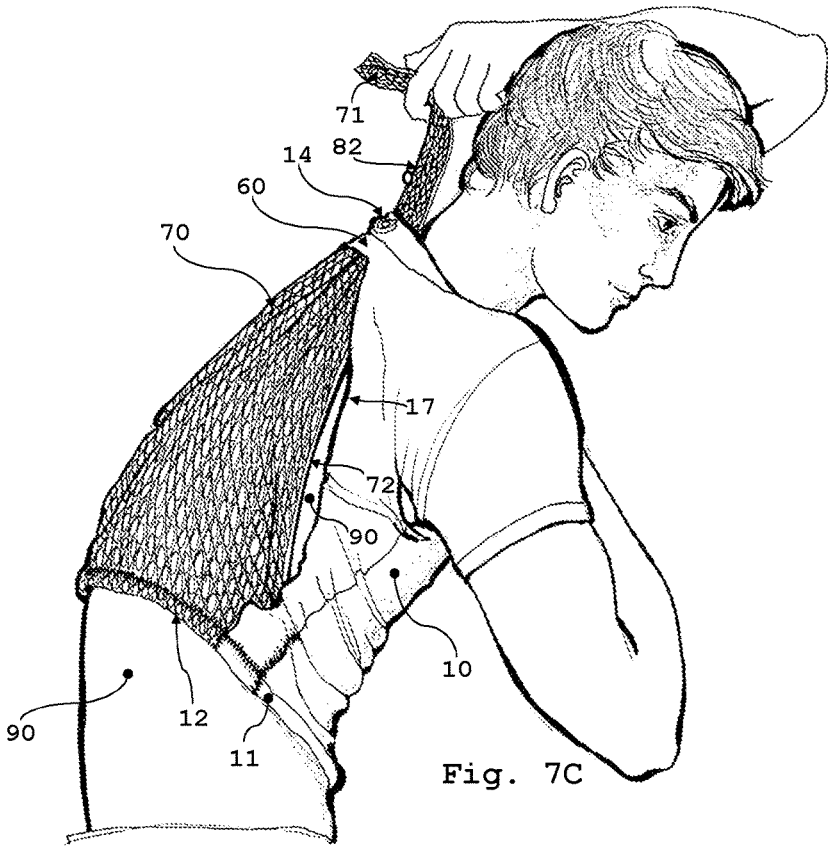

The third embodiment is the most radical solution of the present technical problem depicted in FIGS. 7A, 7B and 7C. Now, the guide is selected to be a tuck-in guide (60) formed between the shoulders of the wearer, and the mesh (50) from the second embodiment is exchanged into the sliding back part (70), FIG. 7C. The tuck-in guide (60) is formed with the material stitched to the sportswear forming a short sleeve on the neck part. The tuck-in guide (60) allows the constriction (82), formed on the said sliding back part (70), to pass across, FIG. 7C. The sliding back part (70) is formed in a trapezoidal form with the constriction (82) that extends from it. The sliding back part (70) can be formed from any material, possibly from any material know in the art, and preferably from the material that is also used to manufacture the rest of the sportswear (10). FIG. 7A depicts the sportswear (10) seen from the back; the sliding back part (70) is only partially visible, being seamed in the joint region (12) to the hemline (11) as in other embodiments. The back part of the sportswear is defined via the joint region (12) below, with the seams (17) forming the sides of the trapezoid, with the beginning of the tuck-in guide (60) on the top.

The sliding back part (70) is rather wide, FIG. 7B, defined by the joint region (12) where it is attached to the hemline (11), with the side hems (72) being situated beneath the sportswear (10), and the top part that is finishing with the constriction (82) suitable to be guided across the tuck-in guide (60). Such constriction (82) is used as a gripping and pulling means that is easily secured to the sportswear via the fastening means (71, 14). The fastening means can be chosen to be ordinary snaps, areas equipped with the Velcro® hooks and loops, or any other fastening means used in the field.

The actual usage of the mentioned variant is depicted in FIG. 7C. By pulling the constriction part (82) it engages the sliding back part (70) to uniformly act on the hemline (11) and lift it up. As depicted, the sliding back part (70) and the rest of the sportswear (10) are permanently separated along the hems (17), and the hems (72) formed on the sportswear (10) are enabling the takeoff helping means to function properly; FIG. 7C. The sliding back part (70) is all the time in contact with the wearer's back skin (90). Being situated on the back, it is evident that the wearer wearing the mentioned sportswear (10) equipped with the said takeoff helping means will technically experience somewhat lower body-mapping fabric tension on one hand. For the sports where perfect body-mapping feature is not essential this particular solution will certainly be sufficient to achieve the desired technical effect.

INDUSTRIAL APPLICABILITY

The present invention is suitable as a simple, reliable and aesthetically acceptable helping means that allows the wet sportswear, in particular the upper sportswear designed to be extremely skintight to the wearer, to be simply taken off over the wearer's head. Therefore, the industrial applicability is obvious.

Considering the fact that elderly people have problems when taking off T-shirts or similar garments over the head due to their health condition, the possible application of the mentioned takeoff helping means is wider than initially being contemplated.

The embodiments hereby mentioned and represented via the figures have to be used only as an example of carrying out the invention as defined by the claims. A skilled person in the art will certainly modify the above embodiments to fit to a desired fashion potential.

REFERENCES

10—sportswear
11—hemline
12—joint region
14—fastening means
17—hem
20—strip guide
21—strip guide beginning
22—strip guide end
23—overlapping region
24—seam
30—strip
31—connecting region
40—mesh guide
41—mesh guide beginning
42—mesh guide end
44—seam
50—mesh
51—fastening means
60—tuck-in guide
70—sliding back part
71—fastening means
72—hem
80—handgrip
81—mesh constriction
82—constriction
90—skin

The invention claimed is:

1. A shirt comprising:

a front portion and a back portion joining at a hemline at a lower portion of the shirt, the front portion and the back portion jointly defining a neck opening opposite the hemline at an upper portion of the shirt, the shirt being adapted to be donned by a wearer over a head of the wearer;

two or more elongated strip guides fixedly coupled to the back portion, each of the two or more elongated strip guides having an upper terminal end and a lower terminal end, the upper terminal end being on the back portion at the neck opening and the lower terminal end being on the back portion at the hemline, each of the two or more elongated strip guides extending from the lower portion of the back portion of the shirt toward the upper portion of the back portion of the shirt, an upper portion of each of the two or more elongated strip guides being at the neck opening of the shirt and a lower portion of each of the two or more elongated strip guides adjacent the hemline of the shirt;

each of the two or more elongated strip guides is provided with a respective strip of a predetermined width, each strip being enclosed by one of the two or more elongated strip guides, each strip being adapted to move linearly with respect to its elongated strip guide, each strip extending past the upper terminal end of its elongated strip guide;

a distal end of each strip is fixedly coupled to the lower portion of the back portion on the hemline; and a handgrip on the back portion being situated adjacent the neck opening and adapted to be gripped by the wearer reaching behind the wearer's head to grasp the handgrip, where the handgrip is fastened to a proximal end of each strip and is adapted to transmit an upward force applied by the wearer to all strips;

wherein the distal ends of each strip lift or retract the hemline toward the upper portion of the shirt to facilitate removal of the shirt.

2. The shirt according to claim 1, wherein each lower portion of each of the two or more elongated strip guides are spaced apart from one another along the hemline.

3. The shirt according to claim 1, wherein the two or more elongated strip guides are formed on an inner surface of the shirt.

4. A shirt comprising:

a front portion and a back portion joining at a hemline at a lower portion of the shirt, the front portion and the back portion jointly defining a neck opening opposite the hemline at an upper portion of the shirt, the shirt being configured to be donned by a wearer over a head of the wearer;

an elongated strip guide fixedly coupled to the back portion, the strip guide having an upper terminal end and a lower terminal end, the upper terminal end being on the back portion at the neck opening and the lower terminal end being on the back portion at the hemline, the strip guide extending from the lower portion of the shirt toward the upper portion of the shirt, an upper portion of the strip guide being at the neck opening of the shirt and a lower portion of the strip guide adjacent the hemline of the shirt;

a strip constrained by the strip guide, the strip having a predetermined width and adapted to move linearly with respect to the strip guide, the strip extending past the upper terminal end of the strip guide;

a distal end of the strip is fixedly coupled to the lower portion of the back portion of the shirt on the hemline; and a handgrip coupled to the strip at a proximal end of the strip, the handgrip being on the back portion situated adjacent a back of the neck opening of the shirt, the handgrip adapted to be behind the wearer's head when the shirt is worn by the wearer and adapted to be gripped by the wearer when the wearer reaches back over and behind the wearer's head, wherein when the handgrip is pulled by the wearer, the handgrip transmits an upward force to the strip;

wherein the distal end of the strip lifts the hemline toward the upper portion of the shirt to facilitate removal of the shirt.

5. The shirt according to claim 4, wherein a width of the lower portion of the strip guide is greater than a width of the upper portion of the strip guide.

6. The shirt according to claim 4, further comprising at least one fastener to detachably couple the strip to the shirt adjacent the neck opening.

7. The shirt according to claim 4, wherein the strip guide is formed on an inner surface of the shirt.

* * * * *